US010544957B2

(12) United States Patent
Takeichi

(10) Patent No.: US 10,544,957 B2
(45) Date of Patent: Jan. 28, 2020

(54) AIR CONDITIONER AND CONTROL METHOD THEREFOR

(71) Applicant: Samsung Electronics Co., Ltd., Suwon-si (KR)

(72) Inventor: Hisashi Takeichi, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/528,378

(22) PCT Filed: Jun. 8, 2015

(86) PCT No.: PCT/KR2015/005712
§ 371 (c)(1),
(2) Date: May 19, 2017

(87) PCT Pub. No.: WO2016/199946
PCT Pub. Date: Dec. 15, 2016

(65) Prior Publication Data

US 2017/0328594 A1 Nov. 16, 2017

(30) Foreign Application Priority Data

Jun. 8, 2015 (KR) ..... 10-2015-0080410

(51) Int. Cl.
*F24F 11/83* (2018.01)
*F25B 41/06* (2006.01)
(Continued)

(52) U.S. Cl.
CPC ..... *F24F 11/83* (2018.01); *F25B 13/00* (2013.01); *F25B 41/062* (2013.01); *F24F 11/84* (2018.01);
(Continued)

(58) Field of Classification Search
CPC ..... F25B 31/004; F25B 2313/02741; F25B 2600/2515; F25B 2600/2519;
(Continued)

(56) References Cited

U.S. PATENT DOCUMENTS 3,777,841 A * 12/1973 Thorner ..... B60K 31/12 123/378
3,867,960 A * 2/1975 Hosoda ..... F16K 11/065 137/625.29
(Continued)

FOREIGN PATENT DOCUMENTS

CN 1119528 C 8/2003
CN 1157576 C 7/2004
(Continued)

OTHER PUBLICATIONS

International Search Report dated Mar. 14, 2016 in corresponding International Application No. PCT/KR2015/005712.
(Continued)

*Primary Examiner* — Nelson J Nieves
(74) *Attorney, Agent, or Firm* — Staas & Halsey LLP

(57) ABSTRACT

Disclosed is an air conditioner and control method thereof. The air conditioner and control method thereof is to improve rapid heating performance without using a large-capacity compressor. The air conditioner includes an indoor unit having a first heat exchanger, an outdoor unit having a compressor and a second heat exchanger, a refrigerant cycle configured to form a refrigerant circulation path between the indoor unit and the outdoor unit, a flow path switch configured to switch a flow of a refrigerant in the refrigerant cycle, and a controller configured to control the flow path switch to allow one part of the refrigerant discharged from the compressor to flow into an inlet of the compressor and the other part of the refrigerant discharged from the compressor to
(Continued)

flow into at least one of the first heat exchanger and the second heat exchanger.

8 Claims, 12 Drawing Sheets

(51) Int. Cl.
*F25B 13/00* (2006.01)
*F24F 11/84* (2018.01)

(52) U.S. Cl.
CPC ... *F25B 2313/006* (2013.01); *F25B 2313/025* (2013.01); *F25B 2313/0233* (2013.01); *F25B 2313/0292* (2013.01); *F25B 2313/02522* (2013.01); *F25B 2313/02523* (2013.01); *F25B 2313/02741* (2013.01); *F25B 2341/06* (2013.01); *F25B 2700/1931* (2013.01)

(58) Field of Classification Search
CPC . F25B 41/046; F25B 13/00; F24F 1/16; F24F 11/83; F24F 11/84
See application file for complete search history.

(56) References Cited

U.S. PATENT DOCUMENTS 3,952,537 A * 4/1976 Aoki ..... F25B 13/00 62/324.6
4,197,719 A * 4/1980 Shaw ..... F04C 18/16 62/324.1
4,494,382 A * 1/1985 Raymond ..... F25B 5/00 417/280
4,644,760 A * 2/1987 Aoki ..... F25B 41/046 137/625.43
4,760,709 A * 8/1988 Aoki ..... F25B 41/046 137/625.43
4,976,286 A * 12/1990 Holborow ..... F25B 41/046 137/625.43
5,768,903 A * 6/1998 Sekigami ..... F25B 13/00 62/196.2
6,024,547 A * 2/2000 Nagae ..... F04C 28/02 417/62
6,076,365 A * 6/2000 Benatav ..... F16K 11/0743 137/625.43
6,619,062 B1 * 9/2003 Shibamoto ..... F04C 18/0253 62/196.1
6,684,651 B1 * 2/2004 Yoshizawa ..... F16K 11/0655 137/625.43
7,152,416 B2 * 12/2006 Lifson ..... F16K 11/0655 62/160
7,895,850 B2 * 3/2011 Kitsch ..... F25B 13/00 62/150
9,909,795 B2 * 3/2018 Shingu ..... F25B 49/022
2003/0101739 A1 * 6/2003 Moon ..... F24F 3/065 62/228.1
2003/0159738 A1 * 8/2003 Lee ..... F15B 13/0406 137/625.43
2005/0103487 A1 * 5/2005 Aflekt ..... B60H 1/00907 165/202
2006/0048527 A1 * 3/2006 Lifson ..... F16K 11/0655 62/160
2006/0242987 A1 * 11/2006 Zhu ..... F16K 31/426 62/352
2012/0000223 A1 * 1/2012 Kinoshita ..... F25B 13/00 62/129
2013/0306301 A1 * 11/2013 Tamaki ..... F25B 30/00 165/287
2014/0130539 A1 * 5/2014 Yoon ..... F25B 31/004 62/470
2015/0096321 A1 * 4/2015 Kawano ..... F25B 1/10 62/197
2015/0128629 A1 * 5/2015 Kawano ..... F25B 9/002 62/160
2015/0362235 A1 * 12/2015 Yamashita ..... F25B 1/10 62/196.1
2016/0003512 A1 * 1/2016 Jung ..... F25B 43/02 62/470
2016/0216015 A1 * 7/2016 Sakai ..... F25B 13/00
2016/0327303 A1 * 11/2016 Tomita ..... F24F 11/89
2017/0010027 A1 * 1/2017 Liu ..... F25B 41/04
2017/0016654 A1 * 1/2017 Shimazu ..... F25B 31/004
2017/0167762 A1 * 6/2017 Kato ..... F25B 13/00
2017/0198696 A1 * 7/2017 Ignatiev ..... F04C 29/04
2017/0234586 A1 * 8/2017 Lv ..... F25B 31/004 62/84
2018/0023868 A1 * 1/2018 Ishiyama ..... F25B 31/004 62/193

FOREIGN PATENT DOCUMENTS

CN 101084401 A 12/2007
JP 9-133417 5/1997
JP 2009-85484 4/2009
JP 2013-217595 10/2013
KR 10-2007-0074301 7/2007
KR 10-2010-0053330 5/2010
KR 10-2010-0090062 8/2010
KR 10-2014-0017865 2/2014
WO 2015/075846 A1 5/2015

OTHER PUBLICATIONS

Chinese Office Action dated Aug. 27, 2019 in related Chinese Application No. 201580080801.6.

* cited by examiner

【Fig. 1】
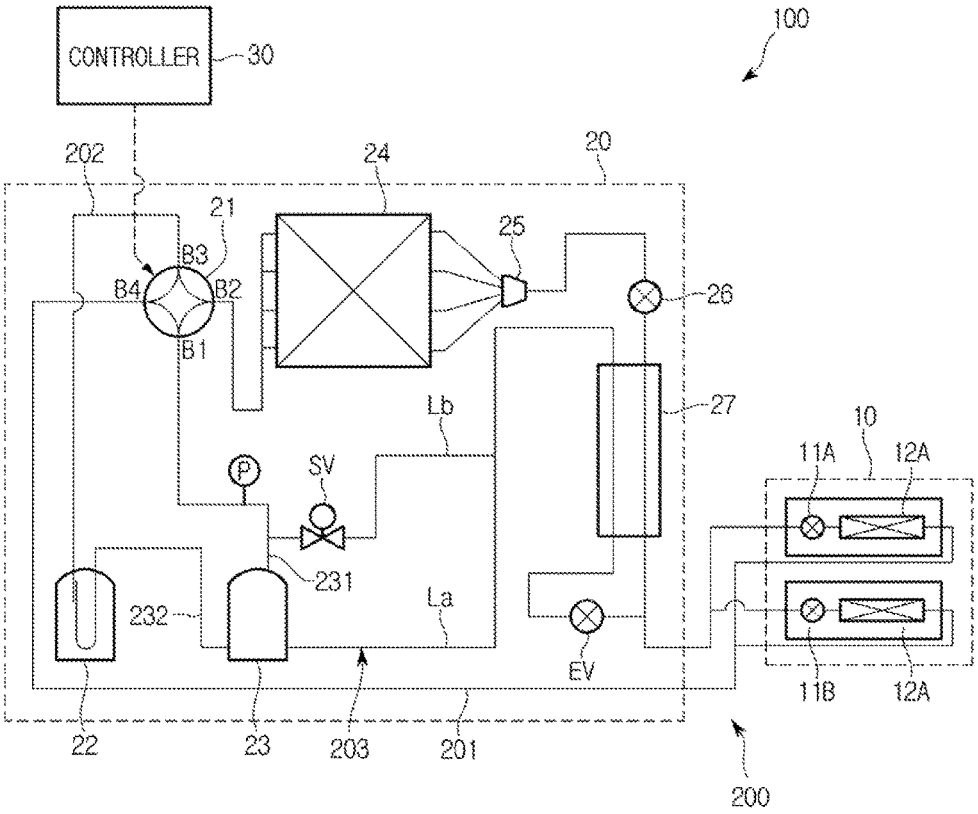

【Fig. 2】
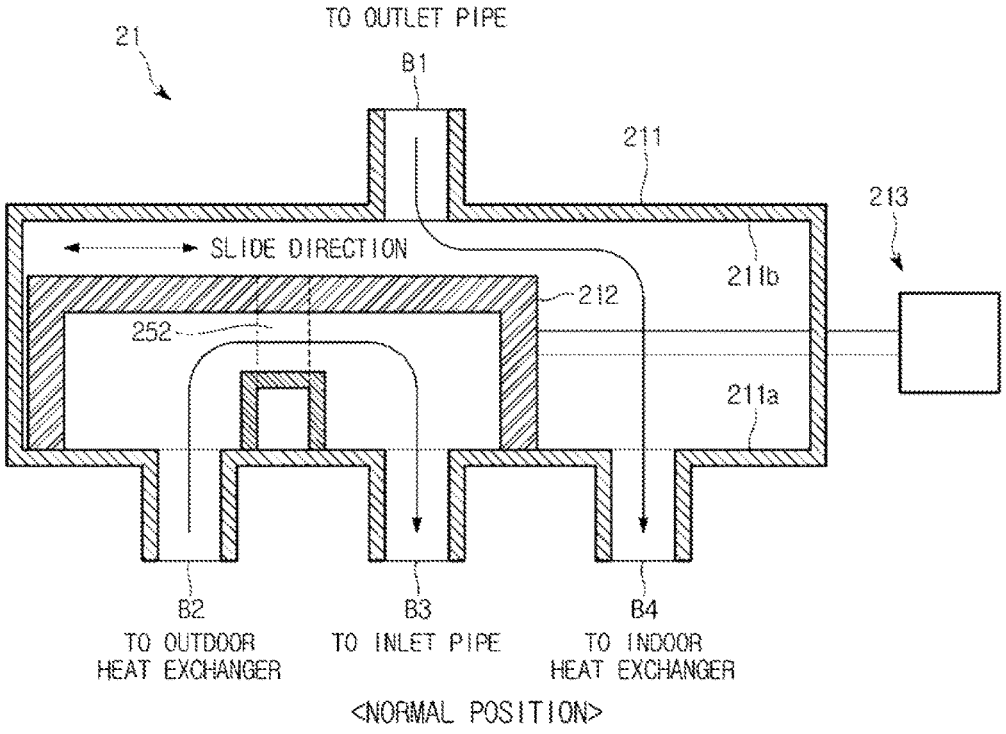

【Fig. 3】
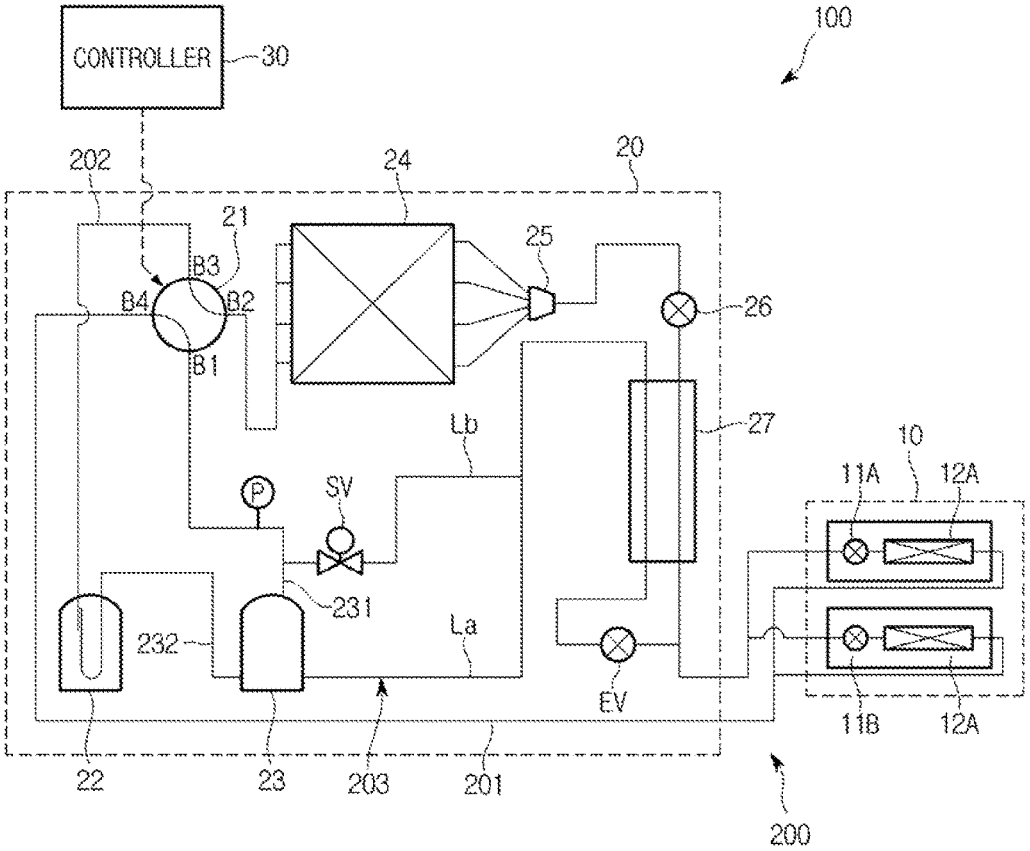
<NORMAL POSITION>

【Fig. 4】
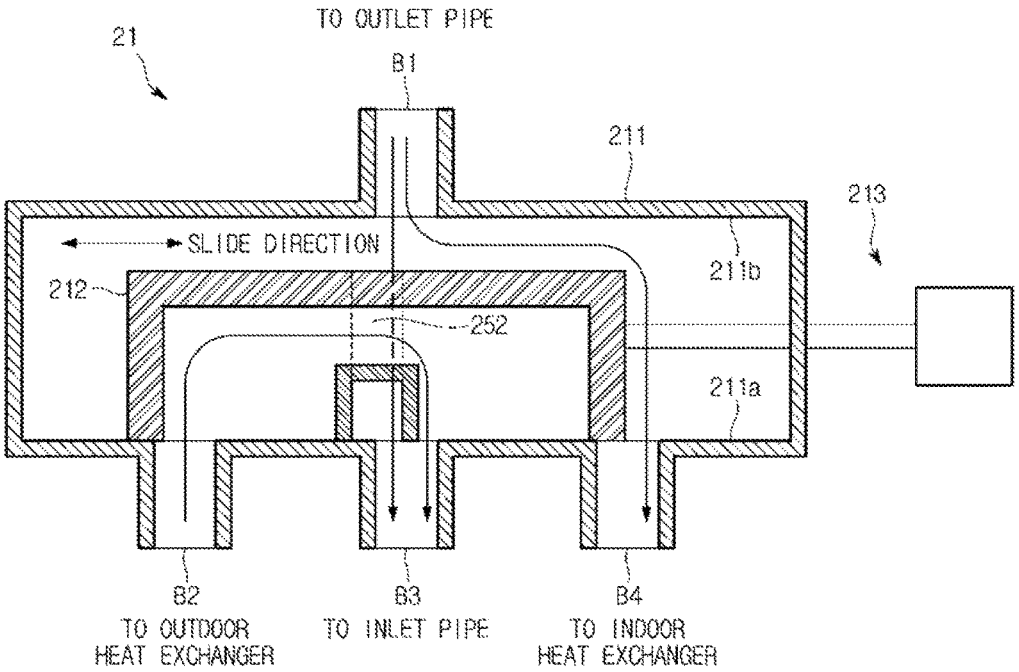
<FIRST INTERMEDIATE POSITION>

【Fig. 5】
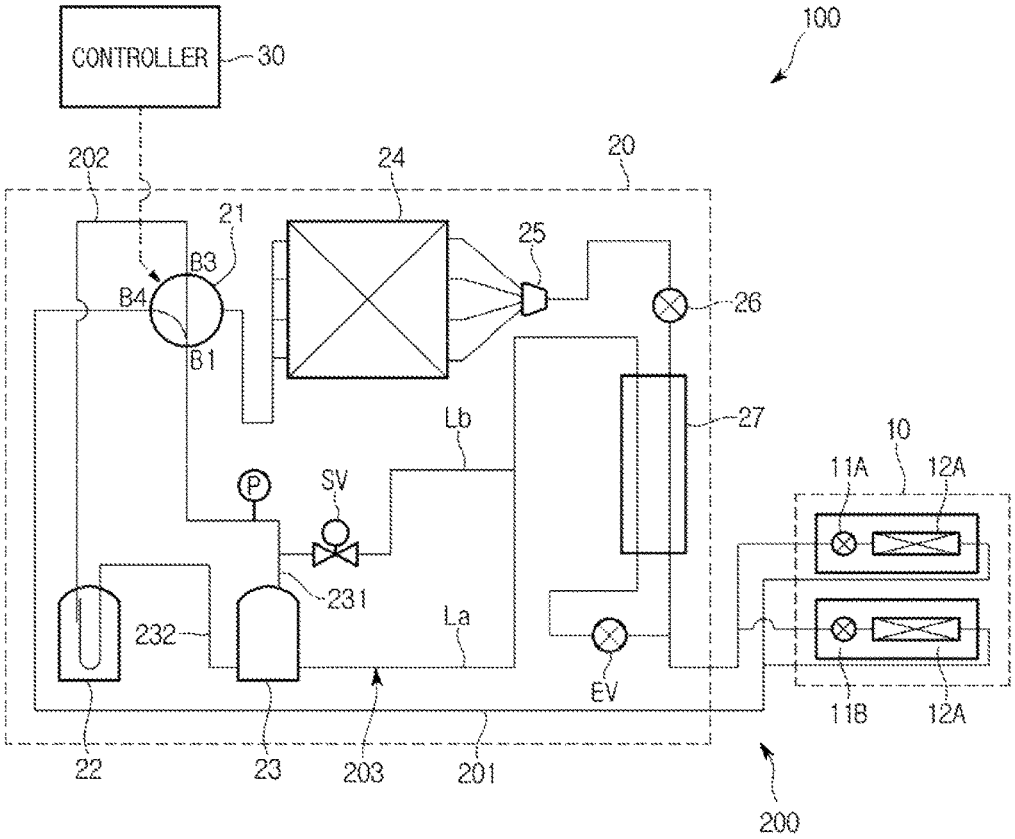
<FIRST INTERMEDIATE POSITION>

【Fig. 6】
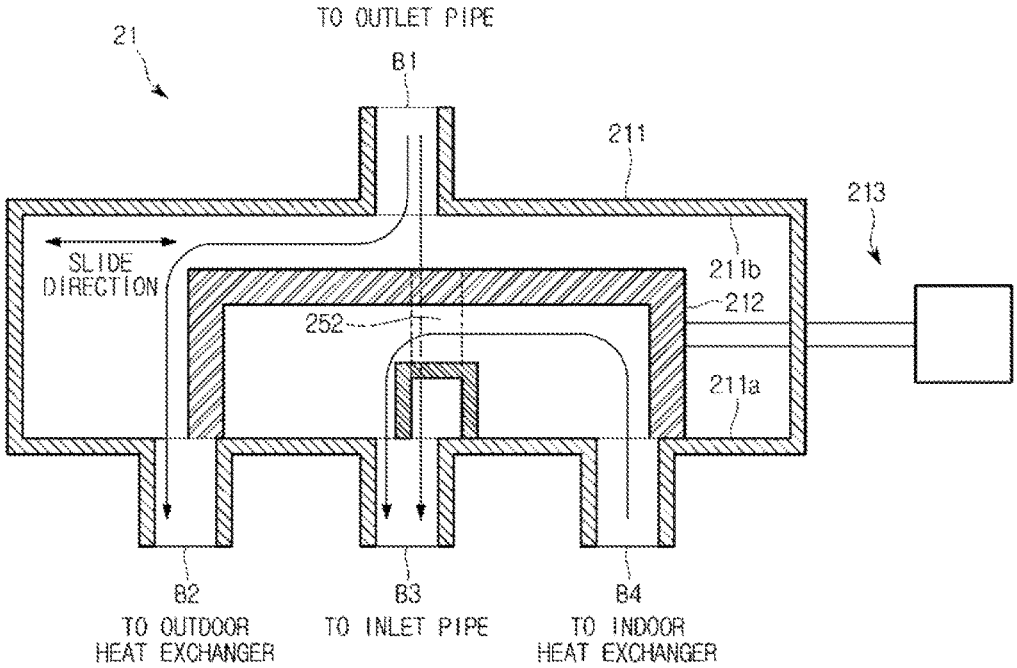
<SECOND INTERMEDIATE POSITION>

【Fig. 7】
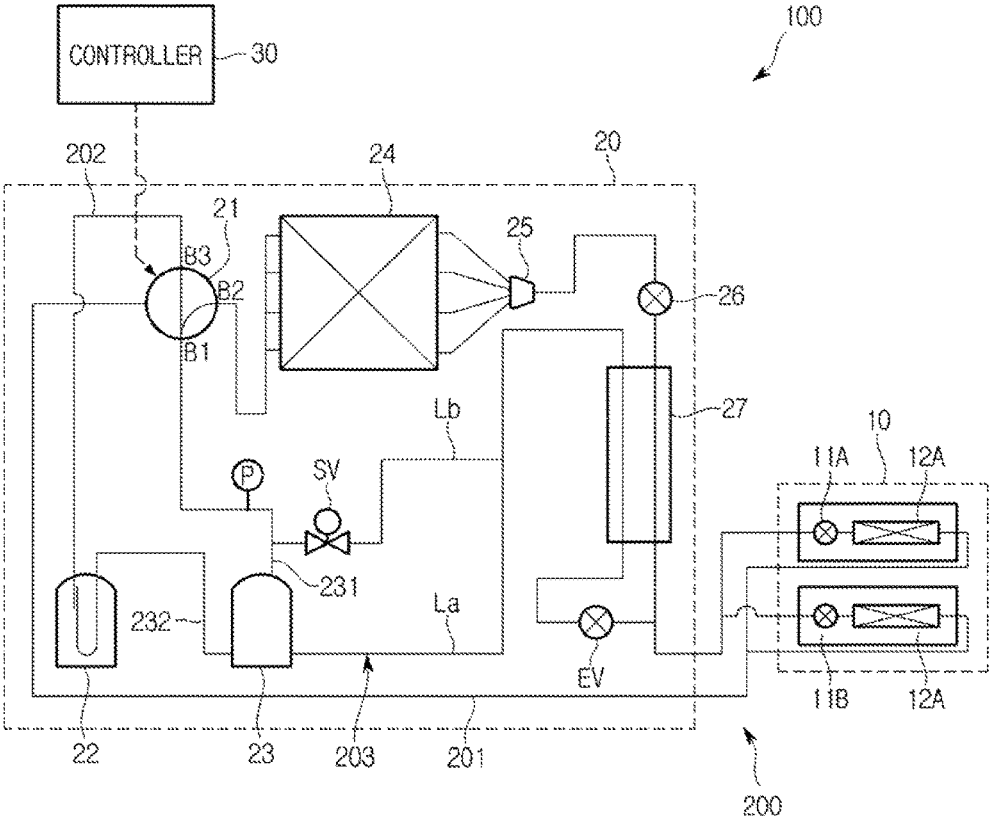
<SECOND INTERMEDIATE POSITION>

【Fig. 8】
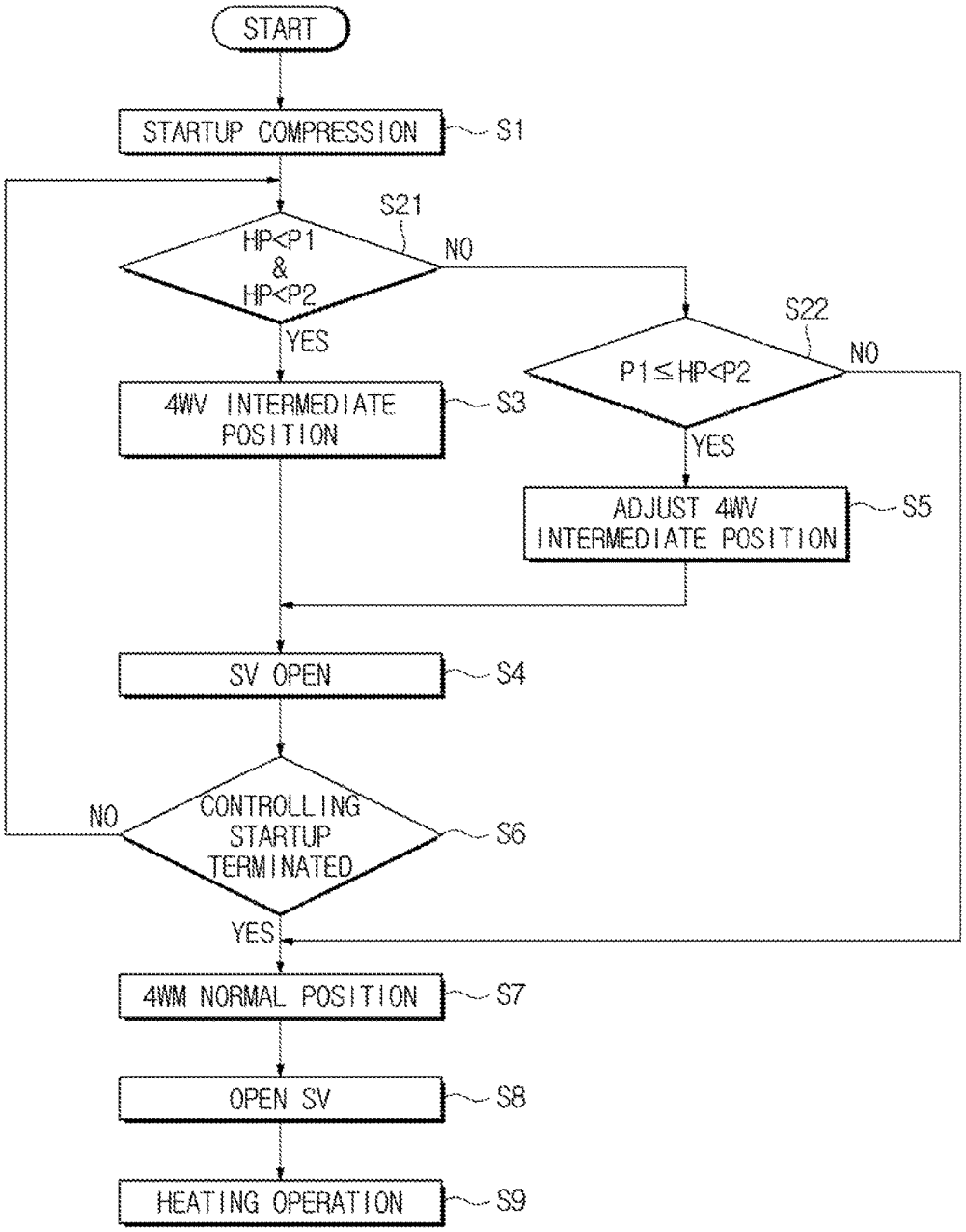

【Fig. 9】
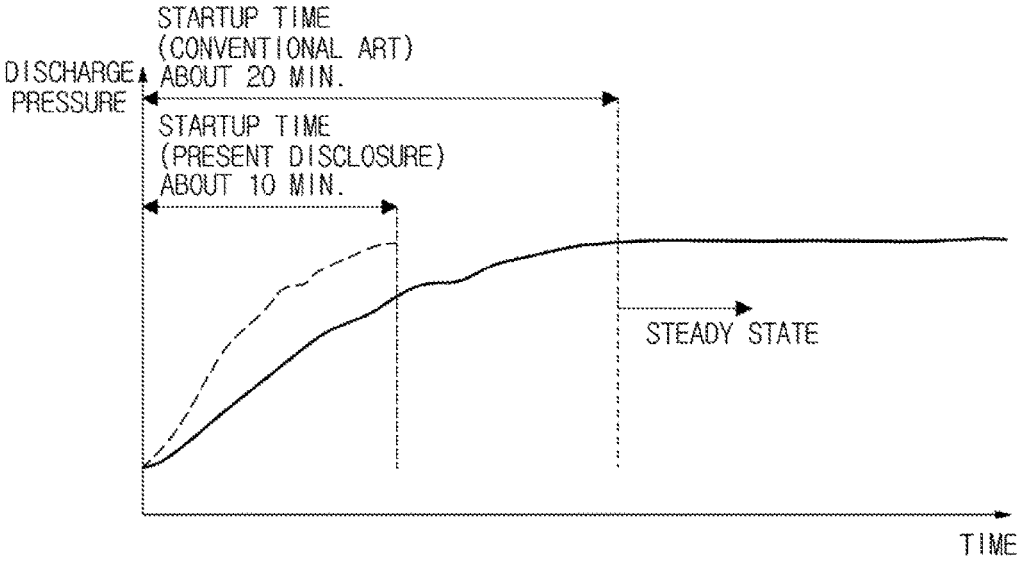

【Fig. 10】
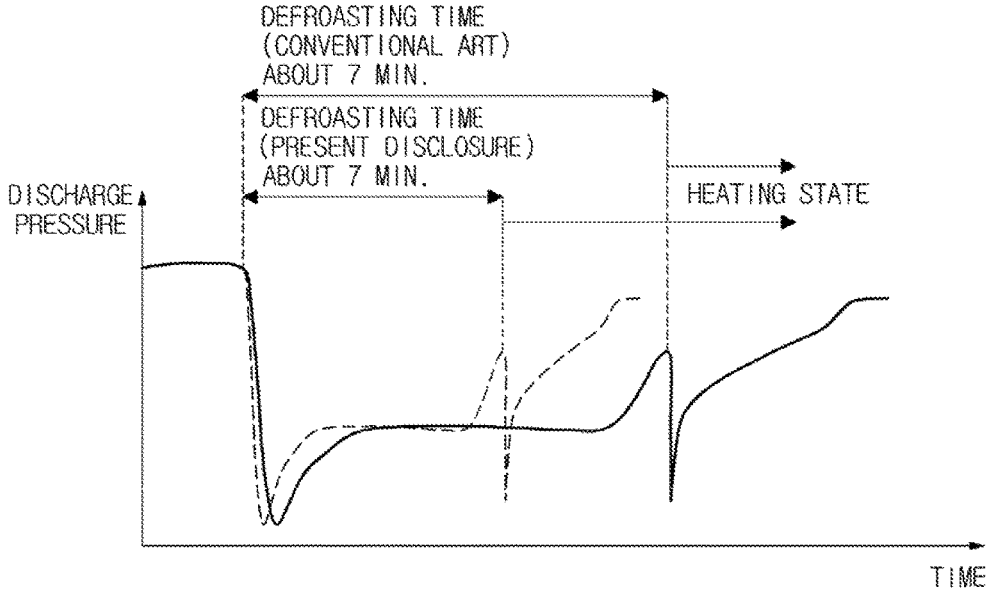

【Fig. 11】
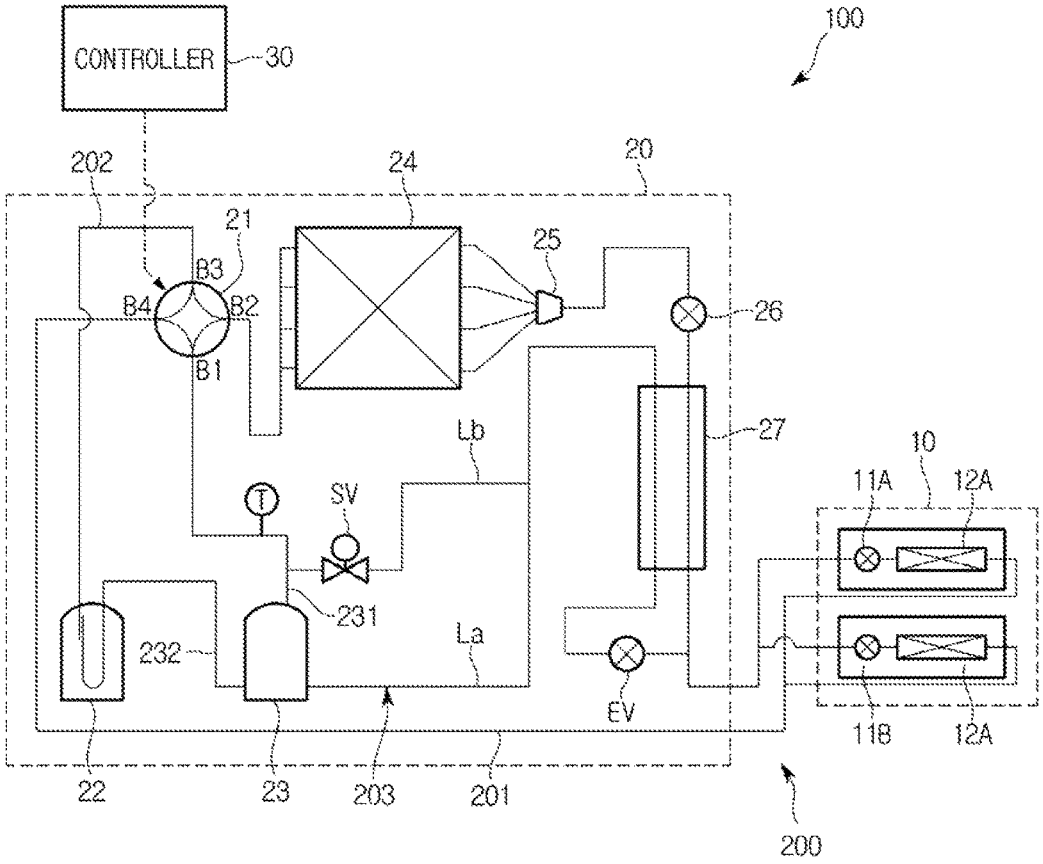

【Fig. 12】
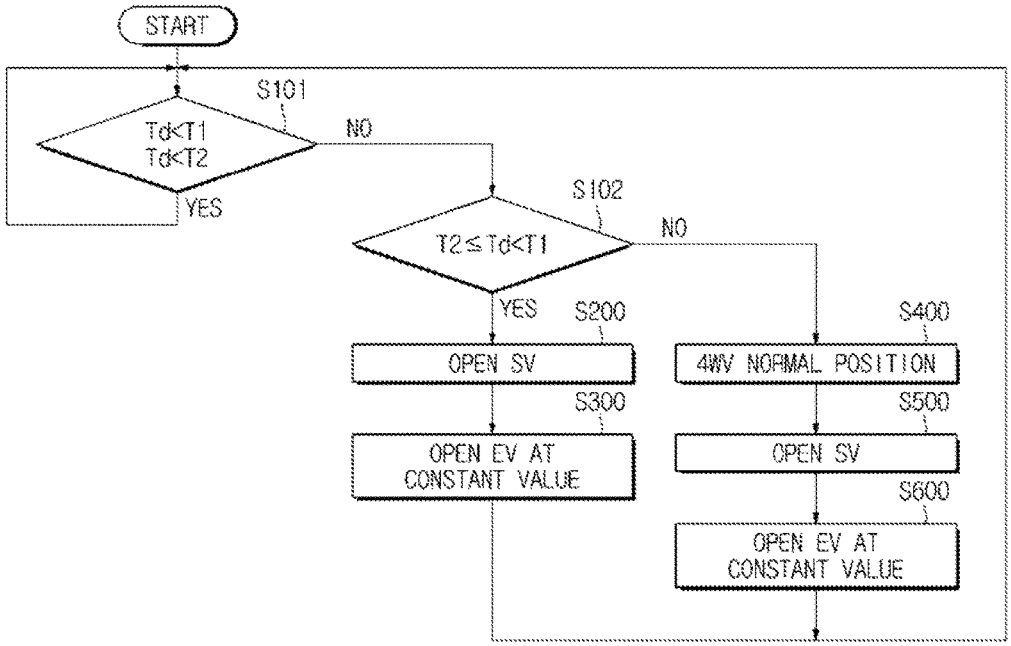

AIR CONDITIONER AND CONTROL METHOD THEREFOR

CROSS-REFERENCE TO RELATED APPLICATIONS

This application is a U.S. National Stage Application, which claims the benefit under 35 U.S.C. § 371 of PCT International Patent Application No. PCT/KR2015/005712, Jun. 8, 2015, which claims the foreign priority benefit under 35 U.S.C. § 119 of Korean Patent Application No. 10-2015-0080410, Jun. 8, 2015, the contents of which are incorporated herein by reference.

TECHNICAL FIELD

Embodiments of the present disclosure relates to an air conditioner and a control method thereof.

BACKGROUND ART

In conventional air conditioners, a large-capacity compressor has been used for rapid heating in which warm air is supplied to the room in a short time. However, a large-capacity compressor has a low reliability of liquid back, and the temperature of the large-capacity compressor rises at each operation start requiring a large amount of heat energy, so that the efficiency of rapid heating is low. Liquid bag is a phenomenon in which a liquid refrigerant, not gaseous refrigerant, is sucked into a compressor due to insufficient evaporation of the refrigerant when the evaporation temperature is lowered below freezing temperature during heating operation.

An air conditioner disclosed in Japanese Patent Publication No. 2009-085484 controls a four-way valve at every startup to communicate an outlet port of the compressor and an inlet port of the compressor, thereby reintroducing the refrigerant discharged from the compressor to the compressor. With this configuration, the refrigerant temperature may be raised within a short time after every startup without using a large capacity compressor.

However, since the refrigerant does not flow into an indoor heat exchanger or an outdoor heat exchanger while raising the temperature of the refrigerant of the compressor in conventional air conditioners, it is difficult to realize rapid heating or rapid defrosting proportional to a rate of raising temperature of the refrigerant.

DISCLOSURE

Technical Problem

According to an aspect of the present disclosure, an object of the present disclosure is to improve the rapid heating performance of an air conditioner without using a large-capacity compressor.

Technical Solution

In accordance with an aspect of the present disclosure, an air conditioner includes: an indoor unit having a first heat exchanger; an outdoor unit having a compressor and a second heat exchanger; a refrigerant cycle configured to form a refrigerant circulation path between the indoor unit and the outdoor unit; a flow path switch configured to switch a flow of a refrigerant flow in the refrigerant cycle; and a controller configured to control the flow path switch to allow one part of the refrigerant discharged from the compressor to flow into an inlet of the compressor and the other part of the refrigerant discharged from the compressor to flow into at least one of the first heat exchanger and the second heat exchanger.

The air conditioner may further include: a first pipe having one end connected to the inlet of the compressor and the other end connected to the indoor unit; and a solenoid valve installed in the first pipe.

The air conditioner may further include: a second pipe having one end connected to the outlet of the compressor and the other end connected to the first pipe; and an opening/closing valve installed in the second pipe.

The air conditioner may further include: a third heat exchanger through which both a main circuit and the first pipe between the outdoor unit and the indoor unit pass.

The flow path switch may include: a valve body having a plurality of ports provided to allow a fluid to pass therethrough; a valve having an opening for communication between an inner space of the valve body and one of the plurality of ports and configured to adjust opening degrees of the plurality of ports and the opening, respectively, according to a positional change when moving forward and backward; and a driver configured to drive the valve to move forward and backward.

The plurality of ports may include a first port connected to an outlet of the compressor, a second port connected to the second heat exchanger, a third port connected to an inlet of the compressor, and a fourth port connected to the first heat exchanger.

In accordance with another aspect of the present disclosure, a method of controlling an air conditioner including an indoor unit having a first heat exchanger, an outdoor unit having a compressor and a second heat exchanger, a refrigerant cycle configured to form a refrigerant circulation path between the indoor unit and the outdoor unit, and a flow path switch configured to switch a flow of a refrigerant in the refrigerant cycle includes: starting up the compressor to discharge the refrigerant; and controlling the flow path switch to allow one part of the refrigerant discharged from the compressor to flow into the inlet of the compressor and the other remaining part of the refrigerant discharged from the compressor to flow into at least one of the first heat exchanger and the second heat exchanger.

The method of controlling the air conditioner may further include: controlling the flow path switch to allow one part of the refrigerant discharged from the compressor flows into the inlet of the compressor and the other part of the refrigerant discharged from the compressor to flow into the first heat exchanger when a pressure of the refrigerant discharged from the compressor is lower than a lower limit of a preset pressure range.

The method of controlling the air conditioner may further include: controlling the flow path switch to allow one part of the refrigerant discharged from the compressor to flow into the inlet of the compressor and the other part of the refrigerant discharged from the compressor to flow into the second heat exchanger when the pressure of the refrigerant discharged from the compressor exceeds an upper limit of the predetermined pressure range.

The method of controlling the air conditioner may further include: adjusting an opening degree of the flow path switch to decrease the pressure of the refrigerant discharged from the compressor when the pressure of the refrigerant discharged from the compressor is equal to or higher than the lower limit of the predetermined pressure range and is lower than the upper limit of the predetermined pressure range.

The method of controlling the air conditioner may further include: adjusting an opening degree of the flow path switch to decrease a temperature of the refrigerant discharged from the compressor when the temperature of the refrigerant discharged from the compressor is equal to or higher than the lower limit of the predetermined temperature range and is lower than the upper limit of the predetermined temperature range.

In accordance with another aspect of the present disclosure, a flow path switching apparatus includes: a valve body having a plurality of ports provided to allow a fluid to pass therethrough; a valve having an opening for communication between an inner space of the valve body and one of the plurality of ports and configured to adjust opening degrees of the plurality of ports and the opening, respectively, according to a positional change when moving forward and backward; and a driver configured to drive the valve to move forward and backward.

The plurality of ports may include a first port connected to an outlet of the compressor, a second port connected to the second heat exchanger, a third port connected to an inlet of the compressor, and a fourth port connected to the first heat exchanger.

The valve is moved forward and backward in a sliding manner.

The valve is moved forward and backward in a spool manner.

Advantageous Effects

According to an aspect of the present disclosure, a heating operation or defrosting operation is performed while rapidly raising the temperature of the refrigerant discharged from the compressor, so that a rapid heating operation or a rapid defrosting operation may be realized without using a large compressor.

According to another aspect of the present disclosure, by generating a resistance in a flow of the refrigerant from a compressor to an indoor heat exchanger or an outdoor heat exchanger, the pressure of the compressor may increase thereby increasing power consumption of the compressor may be improved, and the temperature of the refrigerant may be increased within a short period of time thereby improving rapid heating performance.

According to yet another aspect of the present disclosure, the refrigerant discharged from a compressor to the connection pipe and then flows into the compressor again, thereby increasing a temperature of the refrigerant more rapidly, thereby improving rapid heating performance.

According to yet another aspect of the present disclosure, since one end of the connection pipe is connected to the outlet pipe of the compressor and the other end is connected to an injection pipe, and the connection pipes is easily implemented by merely connecting the existing pipes, a piping structure of an air conditioner may be simplified.

DESCRIPTION OF DRAWINGS

FIG. 1 is a diagram illustrating an air conditioner according to an embodiment of the present disclosure;

FIGS. 2 and 3 are diagrams illustrating a normal position of a four-way valve according to an embodiment of the present disclosure;

FIGS. 4 and 5 are diagrams illustrating a first intermediate position of the four-way valve according to the embodiment of the present disclosure (heating operation after rapid heating operation);

FIGS. 6 and 7 are diagrams illustrating a second intermediate position of the four-way valve according to the embodiment of the present disclosure (defrosting operation after rapid heating operation);

FIG. 8 is a diagram illustrating a control method of an air conditioner according to an embodiment of the present disclosure;

FIG. 9 is a diagram illustrating experimental results of performance of a rapid heating operation of the air conditioner;

FIG. 10 is a diagram illustrating experimental results of performance of a rapid heating operation of an air conditioner;

FIG. 11 is a diagram illustrating an air conditioner according to another embodiment of the present disclosure; and FIG. 12 is a diagram illustrating a control method of an air conditioner according to another embodiment of the present disclosure.

BEST MODE

FIG. 1 is a diagram illustrating an air conditioner according to an embodiment of the present disclosure. As show in FIG. 1, an air conditioner 100 according to the embodiment of the present disclosure includes an indoor unit 10 and an outdoor unit 20. The indoor unit 10 and the outdoor unit 20 are connected to each other through a heat pump cycle 200. The heat pump cycle 200 forms a refrigerant circulation path between the indoor unit 10 and the outdoor unit 20.

The indoor unit 10 includes a plurality of decompressors 11A and 11B connected in parallel with each other and indoor heat exchangers 12A and 12B respectively connected in series to the decompressors 11A and 11B. In the embodiment of the present disclosure, the indoor unit 10 may include three or more indoor heat exchangers connected in parallel. The outdoor unit 20 includes a four-way valve 21, an accumulator 22, a compressor 23, an outdoor heat exchanger 24, a distributor 25, an expansion valve 26, and an auxiliary heat exchanger 27.

The heat pump cycle 200 includes a main circuit 201 and a compression circuit 202. The main circuit 201 connects the decompressors 11A and 11B, the indoor heat exchangers 12A and 12B, the four-way valve 21, the outdoor heat exchanger 24, the distributor 25, the expansion valve 26, and the auxiliary heat exchanger 27 in the order mentioned. The compression circuit 202 connects the accumulator 22, the compressor 23, and the four-way valve 21 in the order mentioned.

The heat pump cycle 200 has an injection flow passage 203 which is provided to branch a part of the refrigerant flowing from the decompressors 11A and 11B to the expansion valve 26 from the main circuit 201 described above. The refrigerant branched by the injection flow path 203 is guided only to the compressor 23 without being guided to the outdoor heat exchanger 24. The injection flow path 203 includes an injection pipe La and the auxiliary heat exchanger 27. One end of the injection pipe La is connected to the compressor 23 and the other end is connected between the expansion valve 26 and the decompressors 11A and 11B. The auxiliary heat exchanger 27 is installed between the compressor 23 of the injection pipe La and a solenoid valve EV. The auxiliary heat exchanger 27 is installed such that the main circuit 201 and the injection flow path 203 pass therethrough.

The outdoor unit 20 of the air conditioner 100 according to the embodiment of the present disclosure is provided with a connection pipe Lb for connecting the compression circuit 202 and the injection flow path 203 described above. One end of the connection pipe Lb is connected to an outlet pipe 231 of the compressor 23 and the other end is connected to the injection pipe La. The connection pipe Lb is provided with an opening/closing valve SV.

The heat pump cycle 200 described above switches a flow of the refrigerant in the main circuit 201 according to opening and closing of four ports B1 to B4 of the four-way valve 21 (see FIG. 2) so that the switching between a cooling operation and a heating operation is performed. The switching of the flow of the refrigerant in the main circuit 201 is performed as follows. In the cooling operation, the flow of the refrigerant is switched such that the refrigerant discharged from the compressor 23 flows into the outdoor heat exchanger 24. In the heating operation, the flow of the refrigerant is switched such that the refrigerant discharged from the compressor 23 flows into the indoor heat exchangers 12A and 12B. The opening and closing of the four-way valve 21 is performed under the control of a controller 30.

FIGS. 2 to 7 are diagrams illustrating a structure and operation of a four-way valve according to an operation mode of the air conditioner according to an embodiment of the present disclosure.

As shown in FIG. 2, the four-way valve 21 includes a valve body 211 having the four ports B1 to B4, a valve 212 for opening and closing of the ports B1 to B4, and a driver 213 to move the valve 212. The four-way valve 21 according to the embodiment of the present disclosure is a slide type configured to linearly move the valve 212 by the driver 213. The four-way valve 21 may also be implemented as a spool type.

The four ports B1 to B4 formed in the valve body 211 include a first port B1, a second port B2, a third port B3, and a fourth port B4. The first port B1 is connected to the outlet pipe 231 of the compressor 23. The second port B2 is connected to the outdoor heat exchanger 24. The third port B3 is connected to the inlet pipe 232 of the compressor 23. The fourth port B4 is connected to the indoor heat exchangers 12A and 12B. The second port B2, the third port B3, and the fourth port B4 are formed on a valve seating surface 211*a* of the valve body 211. The first port B1 is formed on a surface 211*b* opposite to the valve seating surface 211*a*.

The valve 212 opens and closes the second port B2, the third port B3 and the fourth port B4, respectively, while linearly moving in a state of being in contact with the valve seating surface 211*a* by at least one part. An opening 252 is formed in a central portion of the valve 212. The opening 252 is provided to allow the third port B3 to communicate with the inner space of the valve body 211. The third port B3 communicates with the inner space of the valve body 211 via the opening 252 when the valve 212 is in a specific slide position. When the inner space of the valve body 211 communicates with the third port B3, the first port B1 and the third port B3 communicate with each other. In addition, the opening degree at which the first port B1 and the third port B3 communicate with each other may be adjusted according to the slide position of the valve 212. In the embodiment of the present disclosure, the valve 212 moves straight forward and backward in a 'slide direction'. For reference, the first port B1 is always open regardless of the position of the valve 212.

The driver 213 transmits a driving force to the valve 212 and causes the valve 212 to move linearly along the 'slide direction'. In the embodiment of the present disclosure, the valve 212 is implemented by an electric type such as a linear solenoid. The air conditioner 100 according to the embodiment of the present disclosure includes the controller 30 for controlling the driver 213 (see FIG. 1). The valve 212 moves linearly along the 'slide direction' under the control of the driver 213 by the control unit 30. By the movement of the valve 212, the flow direction of the refrigerant is switched, thereby changing the operation state of the air conditioner 100. In addition, the controller 30 finely adjusts the movement of the valve 212 by precisely controlling the driver 213, thereby finely adjusting the opening degrees of the ports B1 to B4 communicating with each other. By fine adjustment of the valve 212, the amount of the refrigerant flowing through the ports B1 to B4 may be finely adjusted.

<Normal Position>

FIGS. 2 and 3 are diagrams illustrating a normal position of the four-way valve according to the embodiment of the present disclosure. The controller 30 of the air conditioner 100 according to the embodiment of the present disclosure moves the valve 212 forward as shown in FIG. 2 during the heating operation so that the first port B1 and the fourth port B4 communicate while simultaneously moving the valve 212 to a position (hereinafter, referred to as a normal position) at which the second port B2 and the third port B3 communicate with each other. When the valve 212 is in the normal position, the four-way valve 21 forms a flow path as shown in FIG. 3. The refrigerant discharged from the compressor 23 flows to the indoor heat exchangers 12A and 12B through the flow path and is discharged from the outdoor heat exchanger 24 to the compressor 23 through the flow path, simultaneously.

<First Intermediate Position: Heating Operation after Rapid Heating Operation>

FIGS. 4 and 5 are diagrams illustrating a first intermediate position of the four-way valve according to the embodiment of the present disclosure (in case of performing heating operation after rapid heating). The controller 30 moves backward the valve 212 slightly to a position illustrated in FIG. 4, which is slightly beyond a position illustrated in FIG. 2 and will be referred to as the first intermediate position, in the heating operation after the rapid heating operation to partially open the fourth port B4 simultaneously allowing the first port B1 and the third port B3 to partially communicate with each other.

More specifically, the controller 30 moves the valve 212 to a position where the valve 212 opens a part of the fourth port B4 in the rapid heating operation performed before performing the heating operation. When the valve 212 is at the first intermediate position, the four-way valve 21 forms a flow path as shown in FIG. 5, and most of the refrigerant discharged from the compressor 23 is reintroduced into the inlet of the compressor 23 via the accumulator through the flow path, and the remaining part of the refrigerant flows into the indoor unit 10.

<Second Intermediate Position: Defrosting Operation after Rapid Heating Operation>

FIGS. 6 and 7 are diagrams illustrating another intermediate position of the four-way valve according to the embodiment of the present disclosure, that is, a second intermediate position (in case of performing defrost operation after rapid heating operation). The controller 30 moves backward the valve 212 to a position illustrated in FIG. 6, which is further beyond the position illustrated in FIG. 4 and will be referred to as the second intermediate position, in the defrosting operation after the rapid heating operation to partially open the second port B2 simultaneously allowing the first port B1 and the third port B3.

More specifically, the controller 30 moves the valve 212 to a position where the valve 212 opens a part of the second port B2 in the rapid heating operation performed before performing the defrosting operation. When the valve 212 is at the second intermediate position, the four-way valve 21 forms a flow path as shown in FIG. 7, and most of the refrigerant discharged from the compressor 23 is reintroduced in the inlet of the compressor 20 via the accumulator 22 through the flow path, and the remaining part of the refrigerant flows into the outdoor unit 20.

Hereinafter, the operation of the valve 212 will be described taking the rapid heating operation performed before the heating operation as an example. When the valve 212 is at the first intermediate position, most of the refrigerant discharged from the compressor 23 is reintroduced into the compressor 23 because the first port B1 and the third port B3 communicate with each other. Since the fourth port B4 is partially open, a part of the refrigerant discharged from the compressor 23 is supplied to the indoor heat exchangers 12A and 12B through the fourth port B4 and the refrigerant discharged from the outdoor heat exchanger 24 is introduced into the compressor 23.

The controller 30 controls the driver 213 according to a pressure of the refrigerant discharged from the compressor 23. The position of the valve 212 may be adjusted in accordance with a pressure HP measured by a pressure sensor P provided on the outlet pipe 231 of the compressor 23 as shown in FIG. 1.

The control unit 30 opens the opening/closing valve SV of the connection pipe Lb during the rapid heating operation such that a part of the refrigerant discharged from the compressor 23 is reintroduced into the compressor 23 via connection pipe Lb and the injection pipe La.

FIG. 8 is a diagram illustrating a control method of an air conditioner according to an embodiment of the present disclosure. When the compressor 23 is started (S1), the controller 30 controls the driver 213 to linearly move the valve 212 from the 'normal position' to the first intermediate position.

Next, the controller 30 compares the pressure HP measured by the pressure sensor P with a predetermined first pressure P1 and a predetermined second pressure P2 (S21 and S22). The predetermined first pressure P1 and the predetermined second pressure P2 are preset values, for example, designed pressures of the compressor 23, or the like. In the embodiment of the present disclosure, the second pressure P2 is higher than the first pressure P1 (the first pressure<the second pressure).

In operation S21 of FIG. 8, if the measured pressure HP is lower than both of the first pressure P1 and the second pressure P2 (YES in operation 21), the controller 30 moves the valve 212 to the first intermediate position (3) and opens the opening/closing valve SV provided in the connection pipe Lb to start the rapid heating operation (S4).

Also, in operation S22 of FIG. 8, if the measured pressure HP is equal to or higher than the first pressure P1 and lower than the second pressure P2 (YES in operation S22), the controller 30 adjusts the first intermediate position of the valve 212 to further open the fourth port B4 to lower the measured pressure HP (S5). When the measured pressure HP is lowered, the controller 30 returns the valve 212 to the first intermediate position to open the opening/closing valve SV provided in the connection pipe Lb to start the rapid heating operation (S4).

After the rapid heating operation is started, the controller 30 determines whether to stop the rapid heating operation (S6). When the rapid heating operation is stopped, the valve 212 is returned to the normal position (S7), the opening/closing valve SV is closed to terminate the rapid heating operation, and the heating operation is started (S8 and S9).

When the rapid heating operation is not completed, the controller 30 returns to the operations S21 and S22 to compare the measured pressure HP with the preset first pressure P1 and the preset second pressure P2.

In the embodiment of the present disclosure, the valve 212 is linearly moved to change the compression amount, thereby controlling the high-pressure. Therefore, when the indoor heat exchangers 12A and 12B and the outdoor heat exchanger 24 show normal performance after the start of the compressor 23, the high pressure, since the pressure becomes high as in the normal heating operation, the valve 212 moved linearly is located at the normal position. In the embodiment of the present disclosure, the rapid heating operation is terminated at this time (S6 and S7).

In addition, when there is a margin in the measurement pressure HP and the designed pressures P1 and P2, rapid heating operation may be performed by further increasing the measurement pressure HP.

If the measured pressure HP does not fall within the above range, that is, if the measured pressure HP is equal to or higher than the second pressure P2 in operations S21 and S22 of FIG. 8, the valve 212 is returned to the normal position (S7), and the heating operation is performed in a state where the opening/closing valve SV provided in the connection pipe Lb is closed (S8 and S9).

FIGS. 9 and 10 are diagrams illustrating experimental results of measuring rapid heating performance of the air conditioner 100 according to the embodiment of the present disclosure. FIG. 9 is a diagram illustrating the experimental results showing performance of the rapid heating operation before the heating operation. FIG. 10 is a diagram illustrating the experimental results showing performance of the rapid heating operation before the defrosting operation.

As shown in FIG. 9, a time (starting time) until the heating operation of the air conditioner 100 reaches a steady state after the start-up of the compressor 23 is shorter than a startup time of a conventional air conditioner. That is, in the conventional air conditioner, the startup time from the start of the compressor to the steady state of the heating operation is about 20 minutes. However, in the air conditioner 100 according to the embodiment of the present disclosure, a startup time until the heating operation reaches the steady state after startup is about 10 minutes which is shorter than that of the conventional air conditioner.

Also, as shown in FIG. 10, in comparison with the conventional air conditioner, when switching from the heating operation to the defrost operation, the air conditioner 100 according to the embodiment of the present disclosure raises the temperature of the refrigerant supplied from the compressor 23 to the outdoor heat exchanger 24 in a shorter time to further shorten the time required for the defrost operation. That is, the conventional air conditioner takes about 7 minutes for defrosting operation when switching from heating operation to defrosting operation. However, the air conditioner 100 according to the embodiment of the present disclosure takes about 4.5 minutes for the defrosting operation when switching from the heating operation to the defrost operation.

The air conditioner 100 according to the present disclosure configured as described above performs the rapid heating by reintroducing a part of the refrigerant discharged from the compressor 23 into the compressor 23 and supplying the remaining part of the refrigerant to the indoor heat exchanger 12A and 12B or the outdoor heat exchanger 24. As a result, the heating operation or the defrost operation may be performed while raising the temperature of the refrigerant. In addition, rapid heating may be achieved without using a large-capacity compressor.

Therefore, in the heating operation, the time from the start of the compressor 23 to the normal operation according to an embodiment may be shorter than that of the conventional air conditioner. In addition, the time required for the defrosting operation may be reduced in comparison with the conventional air conditioner.

The controller 30 controls the driver 213 to adjust the position of the valve 212 such that the pressure of the refrigerant discharged from the compressor 23 is equal to or lower than a predetermined pressure based on the designed pressure of the compressor 23, or the like. As a result, it is possible to prevent breakdown the compressor 23.

The air conditioner 100 according to the embodiment of the present disclosure generates a resistance in a flow of the refrigerant from the compressor 23 to the indoor heat exchangers 12A and 12B or the outdoor heat exchanger 24. This resistance may increase the pressure of the compressor 23 and reduce power consumption of the compressor 23. As a result, the refrigerant temperature may raise in a short time with a low power consumption, and rapid heating performance may be realized.

In addition, the refrigerant discharged from the compressor 23 may be reintroduced into the compressor 23 via the connection pipe Lb. Therefore, the rapid heating performance may be realized by raising the refrigerant temperature within a shorter time.

One end of the connection pipe Lb is connected to the outlet pipe 231 of the compressor 23 and the other end is connected to the injection pipe La. Therefore, since the connection pipe Lb may be simply implemented by connecting the existing pipes, the entire configuration of the air conditioner 100 may be simplified.

FIG. 11 is a diagram illustrating an air conditioner according to another embodiment of the present disclosure. As shown in FIG. 11, a temperature sensor T for measuring the temperature of the refrigerant is provided on the outlet pipe 231 of the compressor 23, and the position of the valve 212, the opening/closing valve SV of the connection pipe Lb, and the solenoid valve EV of the injection pipe La may be controlled based on the detected temperature of the discharged refrigerant.

FIG. 12 is a diagram illustrating a control method of an air conditioner according to another embodiment of the present disclosure. As shown in FIG. 12, temperature Td obtained by the temperature sensor T is compared with a preset first temperature T1 and a preset second temperature T2 (S101 and S102). The first temperature T1 and the second temperature T2 are set as temperatures at which various components such as the compressor 23 and refrigerant, oil and the like may be protected. In the embodiment of the present disclosure, the second temperature T2 is set lower than the first temperature T1 (T2<T1)

In operation S101 of FIG. 12, if the measured temperature Td is lower than the first temperature T1 and the second temperature T2, the comparison is continued.

In operation S102 of FIG. 12, if the measured temperature Td is equal to or higher than the second temperature T2 and lower than the first temperature T1, the opening/closing valve SV provided in the connection pipe Lb is closed (S200), the solenoid valve EV provided in the injection pipe La is opened (S300), and the process returns to operations S101 and S102 the temperature comparison is continued.

In operations S101 and S102 of FIG. 12, when the measured temperature Td is not within the above-described range, that is, when the measured temperature Td is equal to or higher than the first temperature T1, the valve 212 is returned to the normal position (S400), the opening/closing valve SV provided in the connection pipe Lb is closed (S500), the solenoid valve EV provided in the injection pipe La is opened (S600), the process returns to operations S101 and S102, and the temperature comparison is continued.

With this configuration, even if the refrigerant temperature rises due to the rapid heating operation, the refrigerant may maintain a temperature at which various devices such as the compressor 23, refrigerant, oil, and the like are protected. Thus, breakdown of the air conditioner 100 may be prevented.

It is to be understood that the above description is only illustrative of technical ideas, and various modifications, alterations, and substitutions are possible without departing from the essential characteristics of the present disclosure. Therefore, the embodiments and the accompanying drawings described above are intended to illustrate and not limit the technical idea, and the scope of technical thought is not limited by these embodiments and accompanying drawings. The scope of which is to be construed in accordance with the following claims, and all technical ideas which are within the scope of the same should be interpreted as being included in the scope of the right.

The invention claimed is:

1. An air conditioner comprising:

an indoor unit having a first heat exchanger;

an outdoor unit having a compressor having an outlet and a second heat exchanger;

a refrigerant cycle configured to form a refrigerant circulation path from the indoor unit to the outdoor unit;

a flow path switch configured to move between a normal position, a first intermediate position, and a second intermediate position to switch a flow of a refrigerant in the refrigerant cycle, the flow path switch having a valve body having a first port, a second port, a third port, and a fourth port, the first port, the second port, third port, and fourth port being configured to allow the refrigerant to pass through the valve body, a valve element provided in the valve body, the valve element having an opening, a driver configured to drive the valve element between the normal position, the first intermediate position, and the second intermediate position, when the flow path switch is in the normal position, the first port and the fourth port are in communication, and the second port and the third port are in communication, when the flow path switch is in the first intermediate position, the first port is in communication with both the third port and the fourth port, and the second port and the third port are in communication, the first port and third port being connected by the opening, when the flow path switch is in the second intermediate position, the first port is in communication with both the second port and the third port, and the fourth port is in communication with the third port, the first port and the third port being connected by the opening;

a pressure sensor coupled to the outlet of the compressor to sense a refrigerant pressure at the outlet of the compressor; and at least one processor configured to control the driver to control the flow path switch to allow one part of the refrigerant discharged from the compressor to flow into an inlet of the compressor and another part of the refrigerant discharged from the compressor to flow into at least one of the first heat exchanger and the second heat exchanger based on the refrigerant pressure sensed by the pressure sensor.

2. The air conditioner according to claim 1, further comprising:

a first pipe having one end connected to the inlet of the compressor and another end connected to the indoor unit; and a solenoid valve installed in the first pipe.

3. The air conditioner according to claim 2, further comprising:

a second pipe having one end connected to the outlet of the compressor and another end connected to the first pipe; and an opening/closing valve installed in the second pipe.

4. The air conditioner according to claim 2, further comprising a third heat exchanger through which both a main circuit and the first pipe between the outdoor unit and the indoor unit pass.

5. The air conditioner according to claim 1, wherein the valve element being configured to adjust opening degrees of the first port, the second port, the third port, and the fourth port, respectively, according to a positional change when moving between the normal position, the first intermediate position, and the second intermediate position.

6. The air conditioner according to claim 5, wherein the first port is connected to the outlet of the compressor, the second port is connected to the second heat exchanger, the third port is connected to the inlet of the compressor, and the fourth port is connected to the first heat exchanger.

7. The air conditioner according to claim 5, wherein the valve element is moved forward and backward in a sliding manner.

8. The air conditioner according to claim 5, wherein the valve element is a spool valve which is moved forward and backward.

* * * * *